US008256172B2

(12) United States Patent
Benson

(10) Patent No.: US 8,256,172 B2
(45) Date of Patent: Sep. 4, 2012

(54) MODULAR FREE STANDING STRUCTURE

(76) Inventor: Christopher Benson, Plymouth, MA (US)

( * ) Notice: Subject to any disclaimer, the term of this patent is extended or adjusted under 35 U.S.C. 154(b) by 545 days.

(21) Appl. No.: 12/476,770

(22) Filed: Jun. 2, 2009

(65) Prior Publication Data

US 2009/0293378 A1 Dec. 3, 2009

Related U.S. Application Data

(60) Provisional application No. 61/058,541, filed on Jun. 3, 2008, provisional application No. 61/090,618, filed on Aug. 21, 2008.

(51) Int. Cl.

| | |
|---|---|
| ***E04B 2/82*** | (2006.01) |
| ***E04B 9/00*** | (2006.01) |
| ***E04G 1/22*** | (2006.01) |
| ***E04C 2/52*** | (2006.01) |
| ***E04B 2/30*** | (2006.01) |
| ***E04H 12/00*** | (2006.01) |

(52) U.S. Cl. ..... 52/220.1; 52/220.2; 52/126.1; 52/126.5; 52/126.6; 52/126.7; 52/483.1; 52/489.1; 52/650.3

(58) Field of Classification Search ..... 52/126.1, 52/126.5, 126.6, 126.7, 220.1, 220.2, 480, 52/483.1, 489.1, 650.1, 650.3; 248/371, 248/157, 354.1

See application file for complete search history.

(56) References Cited

U.S. PATENT DOCUMENTS

| | | | | |
|---|---|---|---|---|
| 4,682,453 | A * | 7/1987 | Holmgren | 52/126.2 |
| 4,684,097 | A * | 8/1987 | Cox | 248/354.3 |
| 4,930,270 | A * | 6/1990 | Bevacqua | 52/126.1 |
| 5,025,598 | A * | 6/1991 | Manna et al. | 52/126.6 |
| 5,072,557 | A * | 12/1991 | Naka et al. | 52/126.6 |
| 5,459,968 | A * | 10/1995 | Jin | 52/126.6 |
| 5,469,678 | A * | 11/1995 | Zamerovsky | 52/263 |
| 5,561,950 | A * | 10/1996 | Collins et al. | 52/126.6 |
| 5,680,732 | A * | 10/1997 | Skouras | 52/126.1 |
| 6,038,823 | A * | 3/2000 | Gallimore et al. | 52/126.1 |
| 6,363,685 | B1 * | 4/2002 | Kugler | 52/745.05 |
| 6,601,360 | B2 | 8/2003 | Spiers | |
| 6,669,163 | B2 * | 12/2003 | Davis, Jr. | 248/346.01 |
| 6,804,923 | B1 * | 10/2004 | Potter | 52/480 |
| 7,353,639 | B2 * | 4/2008 | Carson | 52/79.5 |
| D607,711 | S * | 1/2010 | Adams et al. | D8/354 |
| 2002/0078638 | A1 * | 6/2002 | Huang | 52/126.6 |
| 2003/0089049 | A1 * | 5/2003 | Scissom et al. | 52/126.1 |
| 2003/0167701 | A1 * | 9/2003 | Rich | 52/79.6 |
| 2009/0057486 | A1 * | 3/2009 | Becht et al. | 244/114 R |
| 2009/0188178 | A1 * | 7/2009 | Lucas et al. | 52/126.1 |
| 2010/0031587 | A1 * | 2/2010 | Weeks | 52/126.6 |
| 2010/0098499 | A1 * | 4/2010 | Bakos | 405/231 |
| 2011/0030288 | A1 * | 2/2011 | Traulsen et al. | 52/126.1 |
| 2011/0088336 | A1 * | 4/2011 | Larsen, Jr. | 52/126.1 |

FOREIGN PATENT DOCUMENTS

JP 05209457 A * 8/1993

* cited by examiner

*Primary Examiner* — Joshua J Michener
*Assistant Examiner* — Ryan Kwiecinski

(57) ABSTRACT

A modular free standing structure and an adjustable footing configured to support the modular free standing structure are described. The structural footing comprises a support member having a support surface configured to provide vertical support to one or more modular platform structures, a base member, and an adjustable leveling mechanism disposed between the support member and the base member, and configured to level adjoining modular platform structures by adjusting a height of the support member relative to the base member about a vertical axis of the structural footing.

18 Claims, 17 Drawing Sheets

MODULAR FREE STANDING STRUCTURE

CROSS-REFERENCE TO RELATED APPLICATIONS

This application is related to and claims priority to U.S. provisional application Ser. No. 61/058,541 filed on Jun. 3, 2008, and U.S. provisional application Ser. No. 61/090,618 filed on Aug. 21, 2008; the entire contents of which are herein incorporated by reference.

BACKGROUND OF THE INVENTION

1. Field of the Invention

The invention relates to a modular free standing structure and a structural footing configured to support the modular free standing structure. In particular, the invention relates to a modular free standing structure and a structural footing configured to support and to adjust the level of the modular free standing structure.

2. Description of Related Art

Free standing structures, such as decks, patios, gazebos, or sheds, are placed on uneven ground and require footings to support their respective platforms. Typically, the footings employed for supporting such free standing structures comprise excavating a hole, pouring concrete, and mounting a support post while drying and hardening the concrete. However, conventional footings are not adjustable and are not amenable to modularity and flexibility in design.

SUMMARY OF THE INVENTION

The invention relates to a free standing structure.

Additionally, the invention relates to a structural footing configured to support a free standing structure. Furthermore, the invention relates to a structural footing configured to support a modular free standing structure.

According to an embodiment, a structural footing configured to support a free standing structure is described. The structural footing comprises a support member having a support surface configured to provide vertical support to one or more modular platform structures, a base member, and an adjustable leveling mechanism disposed between the support member and the base member, and configured to level adjoining modular platform structures by adjusting a height of the support member relative to the base member about a vertical axis of the structural footing.

According to another embodiment, a modular platform structure is described. The modular platform structure comprises: a plurality of platform boards; a module frame configured to support the plurality of platform boards, wherein the module frame comprises one or more receiving openings; and one or more fastening strips configured to secure the plurality of platform boards to the module frame, wherein each of the one or more fastening strips is configured to mate with at least one of the plurality of platform boards and is configured to interlock with at least one of the one or more receiving openings in the module frame.

According to yet another embodiment, a free standing structure is described. The free standing structure comprises a plurality of platform boards; a modular joist structure having one or more interlocking joists, the modular joist structure configured to support the plurality of platform boards; one or more fastening strips configured to secure the plurality of platform boards to the modular joist structure; and a plurality of structural footings configured to adjustably support the modular joist structure.

DETAILED DESCRIPTION OF EXEMPLARY EMBODIMENTS

In the following description, for purposes of explanation and not limitation, specific details are set forth, such as particular design for a free standing structure. However, it should be understood that the invention may be practiced in other embodiments that depart from these specific details.

Figure 1:
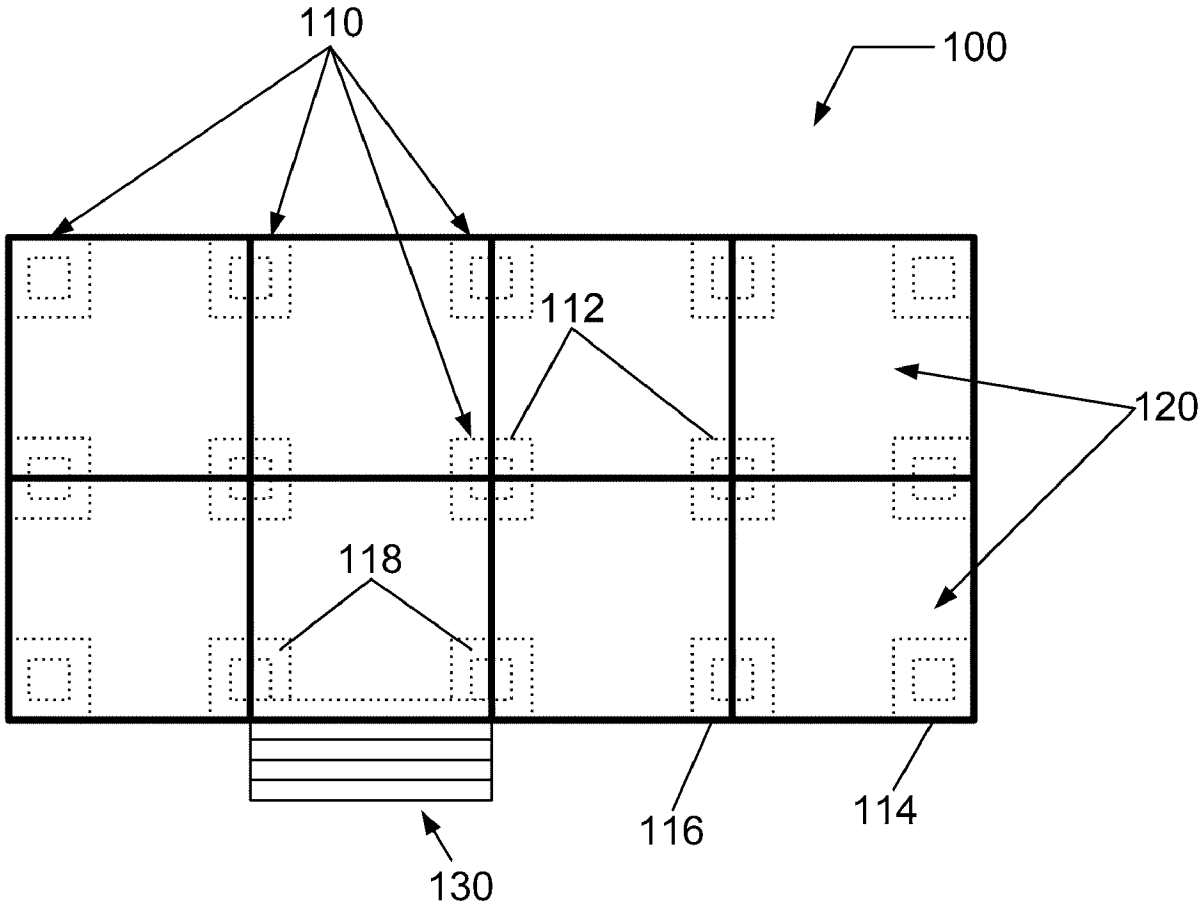
FIG. 1 illustrates a plan view of a modular free standing structure according to an embodiment.

Referring now to FIG. 1, a plan view of a free standing structure 100 is provided according to an embodiment. The free standing structure 100 may, for example, comprise an indoor free standing structure, or an outdoor free standing structure, or a combination thereof. Further, the free standing structure 100 may, for example, comprise a deck, a patio, a gazebo, or a shed.

As shown in FIG. 1, the free standing structure 100 comprises one or more modular platform structures 120 adjustably supported by a plurality of structural footings 110. The plurality of structural footings 110 may comprise one or more interior structural footings 112 configured for interior support of the free standing structure 100, one or more outer corner structural footings 114 configured for outer corner support of the free standing structure 100, one or more outer edge structural footings 116 configured for outer edge support of free standing structure 100, and one or more inner corner structural footings (not shown) for support of the free standing structure 100.

Also, as shown in FIG. 1, the free standing structure 100 may comprise a modular stair system 130. The modular stair system 130 comprises adjustable stairs having a first end configured to mate with at least one of the plurality of structural footings 110 and a second end configured to land on a ground surface. Alternatively, the modular stair system 130 comprises adjustable stairs having a first end configured to mate with at least one of the one or more modular platform structures 120 and a second end configured to land on a ground surface.

Figure 2:
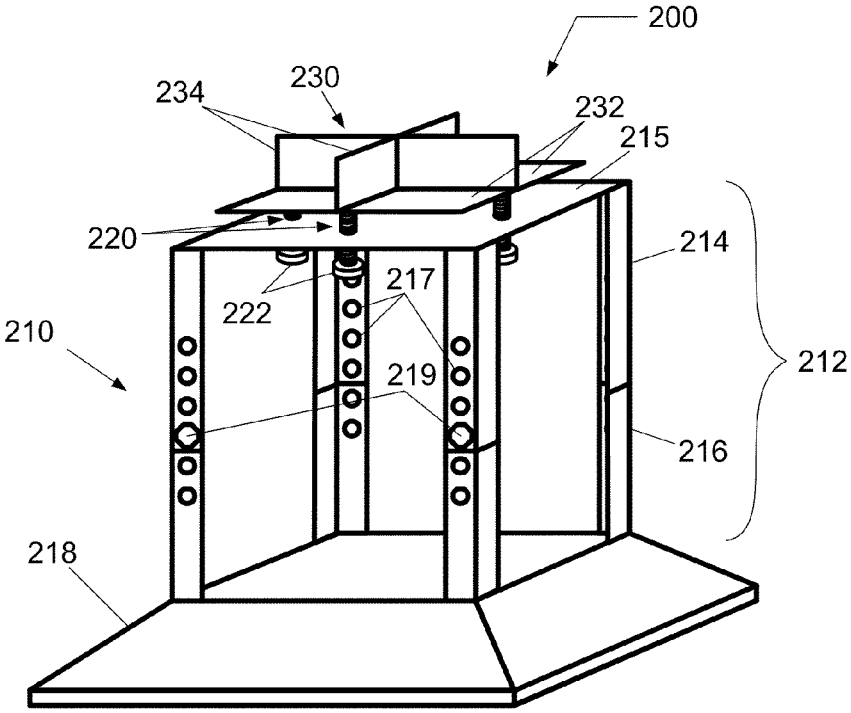
FIG. 2 provides a perspective view of a structural footing according to an embodiment.

Referring now to FIG. 2, a perspective view of a structural footing 200 is provided according to an embodiment. The structural footing 200 comprises a support member 230 configured to provide vertical support to one or more modular platform structures, a base member 210, and an adjustable leveling mechanism 220 disposed between the support member 230 and the base member 210, and configured to level adjoining modular platform structures by adjusting a height of the support member 230 relative to the base member 210. The support member 230 may be configured to provide horizontal interconnectivity for the one or more modular platform structures.

The structural footing 200 may be configured for free standing structures, such as decks, patios, gazebos, or sheds that stand off the ground at any supportable height. As an example, the structural footing 200 may be configured for free standing structures that stand up to 30 inches off the ground in order to satisfy national building code which requires footings to extend below the frost level in geographic areas with frost for structures standing above 30 inches off the ground.

The structural footing 200 may provide both vertical support for modular platform structures, while providing adjustable leveling capability and horizontal support and/or connectivity that may have the ability to secure multiple, independent modular platform structures, such as structural decking sections and/or modules, into one combined structural unit or free standing structure. For instance, independent, structural deck modules can be leveled and joined together by a single footing device.

The adjustable leveling capability can have multiple, independent, adjustable vertical supports that will support and connect multiple, independent structural deck modules in one common footing. For example, a platform deck can have one inside corner adjustable footing that may be able to support and connect four independent structural deck modules. This footing provides an easy-to-use, easy-to-level deck footing for the do-it-yourself consumer or for a professional installer to save time and money.

Additionally, the structural footing 200 may have the ability to support and secure multi-level deck platforms in one common footing device. There may be different lengths of footings available to support a deck up to 30 inches off the ground. The different footing lengths may be necessary to keep a deck level in areas with sloping terrain or uneven terrain. Since each structural footing may have a maximum ability to adjust the platform, then the different lengths of footings may provide for improved application for terrains with more than several inches of change from the deck leveling between structural footings.

Further, each structural footing 200 may be able to accommodate multiple configurations for the support member 230 in one common base. This ability may allow for a structural footing that may be used for an inside corner, an outside corner, an interior vertex, or an outer edge (or run) for multiple modular structural platforms. These multiple securing plate configurations may be for inside corners, outside corners, interior vertices, outside edges, or even a change in height between modules for a multi-level free standing structure. Additionally, if the free standing structure is to be expanded in size, the same footings may be used and the support members may be changed to accommodate the new layout. Each structural footing allows for ease-of-use in assembling, and in disassembling in the case of re-leveling, moving to a new location or changing the layout.

As shown in FIG. 2, the structural footing 200 comprises base member 210 having a main footing 212, and an expanded (or flared) base 218 coupled to the main footing 212 to provide stability to the structural footing 200. The main footing 212 may comprise an upper footing section 214, a lower footing section 216 coupled to the upper footing section 214 and the expanded base 218, and a support table 215 coupled to the upper section 214.

The vertical position of the upper footing section 214 may be adjusted relative to the lower footing section 216. For example, a range for adjusting the upper footing section 214 relative to the lower footing section 216 may range from about 5 inches to about 25 inches. Alternatively, for example, a range for adjusting the upper footing section 214 relative to the lower footing section 216 may range from about 6 inches to about 20 inches. As shown in FIG. 2, the upper footing section 214 and the lower footing section 216 may comprise one or more fastening locations 217 configured to receive one or more fasteners 219.

Referring still to FIG. 2, the adjustable leveling mechanism 220 comprises one or more support bolts 222 having an end in contact with a bottom of the support member 230. The one or more support bolts 222 are configured to support and adjust the height of the support member 230 relative to the support table 215 of the base member 210. As shown in FIG. 2, the one or more support bolts 222 comprise threaded sections which intimately mate with tapped holes through the support table 215. As the one or more support bolts 222 are rotated through the tapped holes in the support table 215, the vertical height of the support member 230 may be adjusted.

Although the adjustable leveling mechanism 220 is shown to comprise one or more support bolts 222, other devices may be employed to adjust the support member 230 relative to the base member 210. The adjustable leveling mechanism 220 may comprise one or more slides with one or more latching devices. For example, the adjustable leveling mechanism 220 may comprise one or more first cylinders coupled to the support member 230 and one or more second cylinders, concentric with the one or more first cylinders, coupled to the base member 210. One or more spring-loaded devices coupled to an interior cylinder may insert a bolt or plug through holes that align between the interior cylinder and an exterior cylinder. The one or more spring-loaded devices may include a helical spring or loaded lever, for instance. Although in this example, cylinders are suggested other cross-sectional shapes may be used, including square cross-sections, rectangular cross-sections, or angle iron.

Alternatively, if the base member 210 is closed, hence, limiting access to the interior of the base member 210, the adjustable leveling mechanism 220 may comprise one or more support rods having a threaded end configured to mate with a top of the base member 210 and, when turned in the space between the support member 230 and the base member 210 causes adjustment of the height of the support member 230 and the base member 210.

A range for adjusting the support member 230 relative to the support table 215 using the one or more support bolts 222 may range from about 1 inch to about 5 inches. Alternatively, a range for adjusting the support member 230 relative to the support table 215 using the one or more support bolts 222 may range from about 1 inch to about 3 inches. This range may vary depending on the size and structural support strength of each support mechanism, for instance.

Referring still to FIG. 2, the support member 230 comprises an interlocking support plate 232 having the support surface configured to support the one or more modular platform structures. Further, the support member 230 comprises one or more interlocking members 234, such as interlocking walls, configured to mate with the one or more modular platform structures. These interlocking members will be in multiple layout configurations depending on both the number of modular platforms being secured and the specific type of fasteners being used for securing the modular platforms to the interlocking support plates.

Figure 3A:
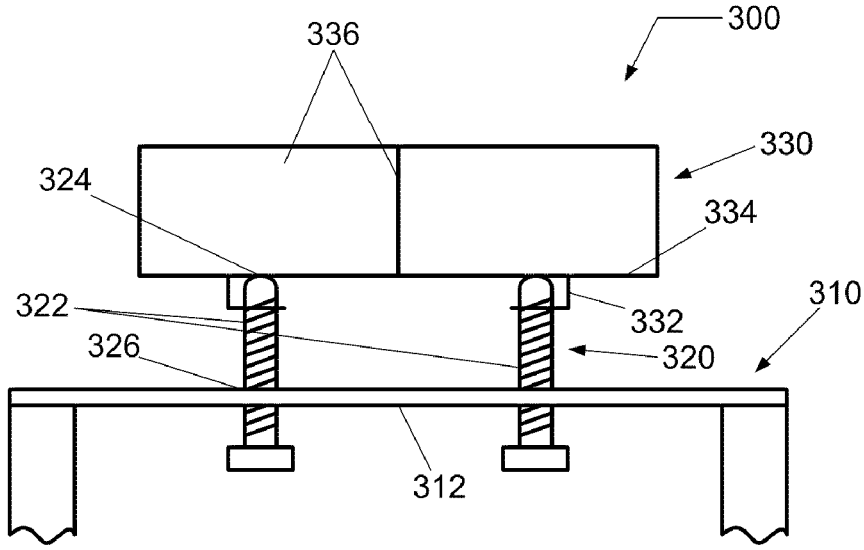
FIGS. 3A and 3B provide side views of an adjustable leveling mechanism for a structural footing according to an embodiment.
Figure 3B:
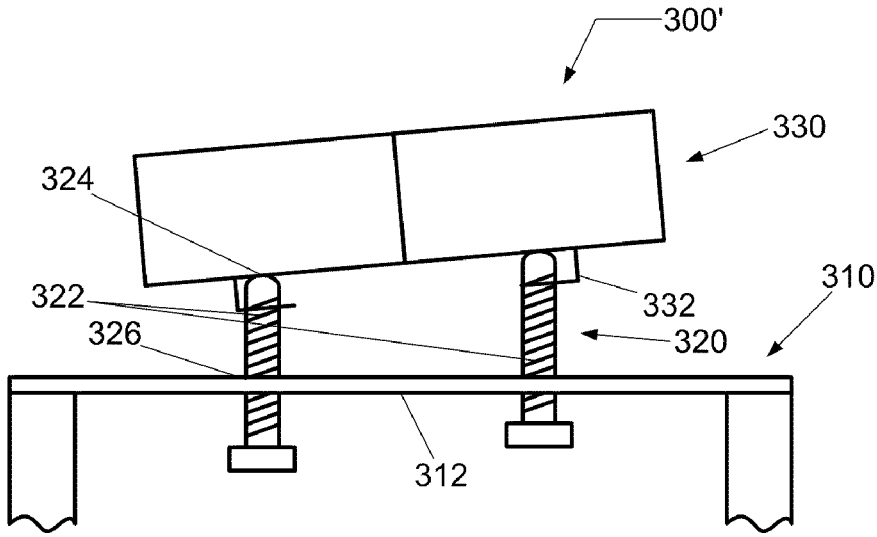

Referring now to FIGS. 3A and 3B, an exploded side view of a structural footing 300, 300' is provided according to other embodiments. In FIG. 3A, the structural footing 300 comprises a base member 310, a support member 330, and an adjustable leveling mechanism 320 disposed there between. The adjustable leveling mechanism 320 comprises a plurality of support bolts 322, each having an end 324 in contact with a bottom surface 334 of the support member 330, and wherein the plurality of support bolts 322 are configured to support and adjust the height of the support member relative to the support table 312 of the base member 310. The plurality of support bolts 322 comprise threaded sections which intimately mate with tapped holes 326 through the support table 312. As the plurality of support bolts 322 are rotated through the tapped holes 326 in the support table 312, the vertical height of the support member 330 may be adjusted (see FIG. 3B).

Furthermore, the support member 330 may comprise one or more retention members 332 configured to retain and align the plurality of support bolts 322.

Figure 3C:
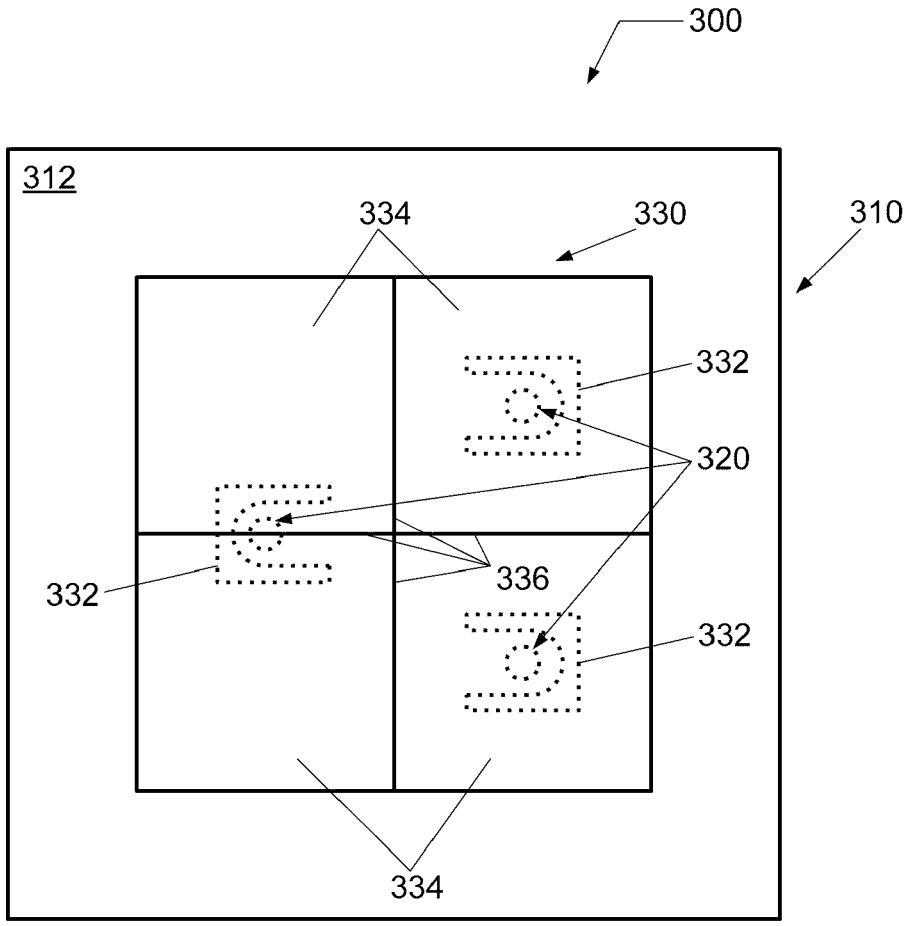
FIG. 3C provides a top view of the adjustable leveling mechanism depicted in FIG. 3A.

FIG. 3C provides a top view of the footing structure 300. The support member 330 comprises a support surface 334 and one or more interlocking members 336, such as interlocking walls, configured to mate with the one or more modular platform structures. The support member 330 of FIGS. 3A, 3B and 3C may be configured to support four modular platform structures.

Figure 4A:
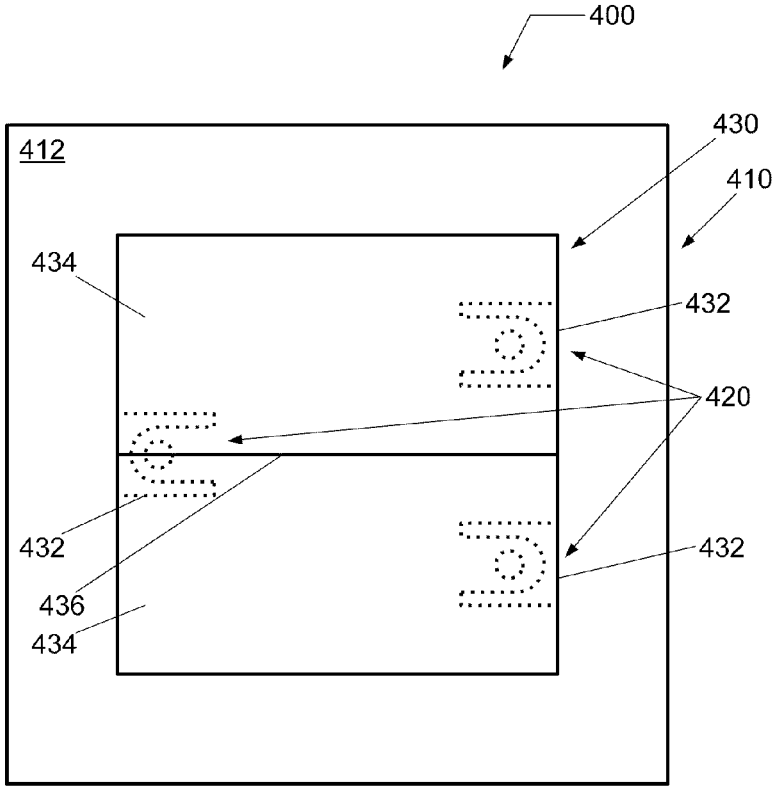
FIG. 4A provides a top view of an adjustable leveling mechanism for a structural footing according to another embodiment.

Referring now to FIG. 4A, a top view of a footing structure 400 is provided according to another embodiment. The structural footing 400 comprises a base member 410, a support member 430, and an adjustable leveling mechanism 420 disposed there between. The adjustable leveling mechanism 420 comprises a plurality of support bolts, each having an end in contact with a bottom surface of the support member 430, and wherein the plurality of support bolts are configured to support and adjust the height of the support member 430 relative to a support table 412 of the base member 410. The plurality of support bolts comprise threaded sections which intimately mate with tapped holes through the support table 412. Furthermore, the support member 430 may comprise one or more retention members 432 configured to retain and align the plurality of support bolts. The support bolt pattern and support member may be changed in size and number of support bolts to best suit the application and function.

The support member 430 comprises a support surface 434 and one or more interlocking members 436, such as interlocking walls, configured to mate with the one or more modular platform structures. The support member 430 of FIG. 4A may be configured to support two modular platform structures or more.

Figure 4B:
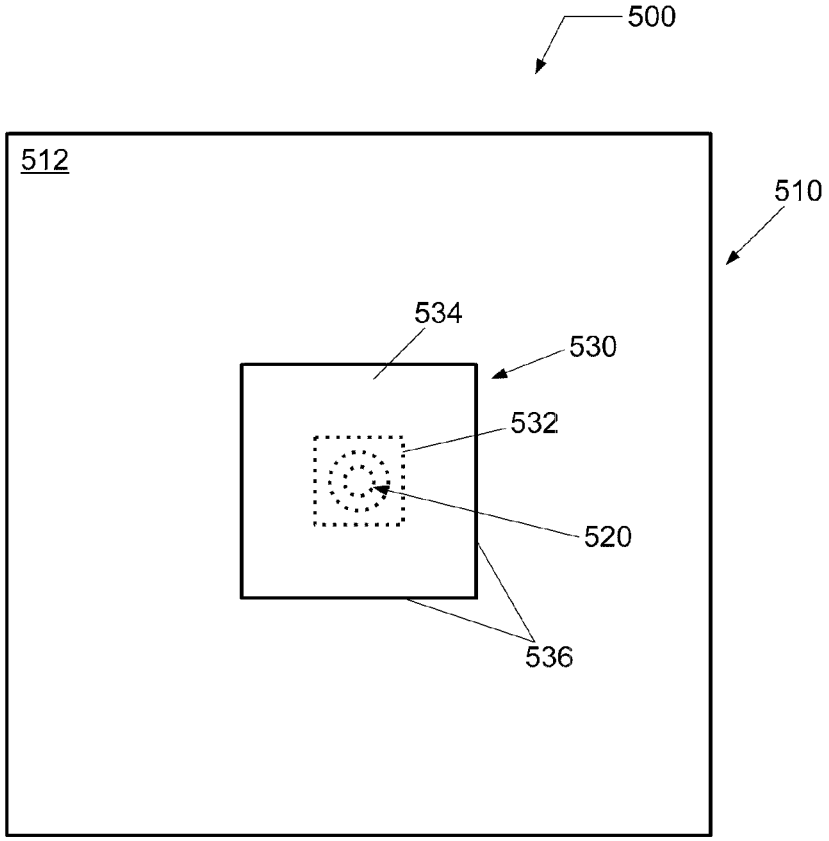
FIG. 4B provides a top view of an adjustable leveling mechanism for a structural footing according to another embodiment.

Referring now to FIG. 4B, a top view of a footing structure 500 is provided according to another embodiment. The structural footing 500 comprises a base member 510, a support member 530, and an adjustable leveling mechanism 520 disposed there between. The adjustable leveling mechanism 520 comprises a plurality of support bolts, each having an end in contact with a bottom surface of the support member 530, and wherein the plurality of support bolts are configured to support and adjust the height of the support member 530 relative to a support table 512 of the base member 510. The plurality of support bolts comprise threaded sections which intimately mate with tapped holes through the support table 512. Furthermore, the support member 530 may comprise one or more retention members 532 configured to retain and align the plurality of support bolts. The support bolt pattern and support member may be changed in size and number of support bolts to best suit the application and function.

The support member 530 comprises a support surface 534 and one or more interlocking members 536, such as interlocking walls, configured to mate with the one or more modular platform structures. The support member 530 of FIG. 4B may be configured to support one modular platform structures or more.

The structural footings provided in FIGS. 2, 3A, 3B, 3C, 4A, and 4B may be constructed out of almost any type of material including, but not limited to, a composite material, a metal, wood, or plastic. Also, the structural footings as a whole or in parts, may be constructed in any shape or form (e.g., circular, ovular, rectangular, square, octaganol, polygonal, etc.), or the structural footings may comprise differing configurations (e.g., one single support base or multiple, smaller, independent support bases connected by a common base plate and top plate).

In addition to the main function of the footings for supporting and connecting the modular platforms (e.g., deck modules), the footings may also have the ability to secure additional accessories that assist in the completion of the structure. For example on a deck, there may be attachments for the structural footings available to secure adjustable stair/step/railing brackets, fascia/skirt board holders, and post/railing support holders.

Figure 5:
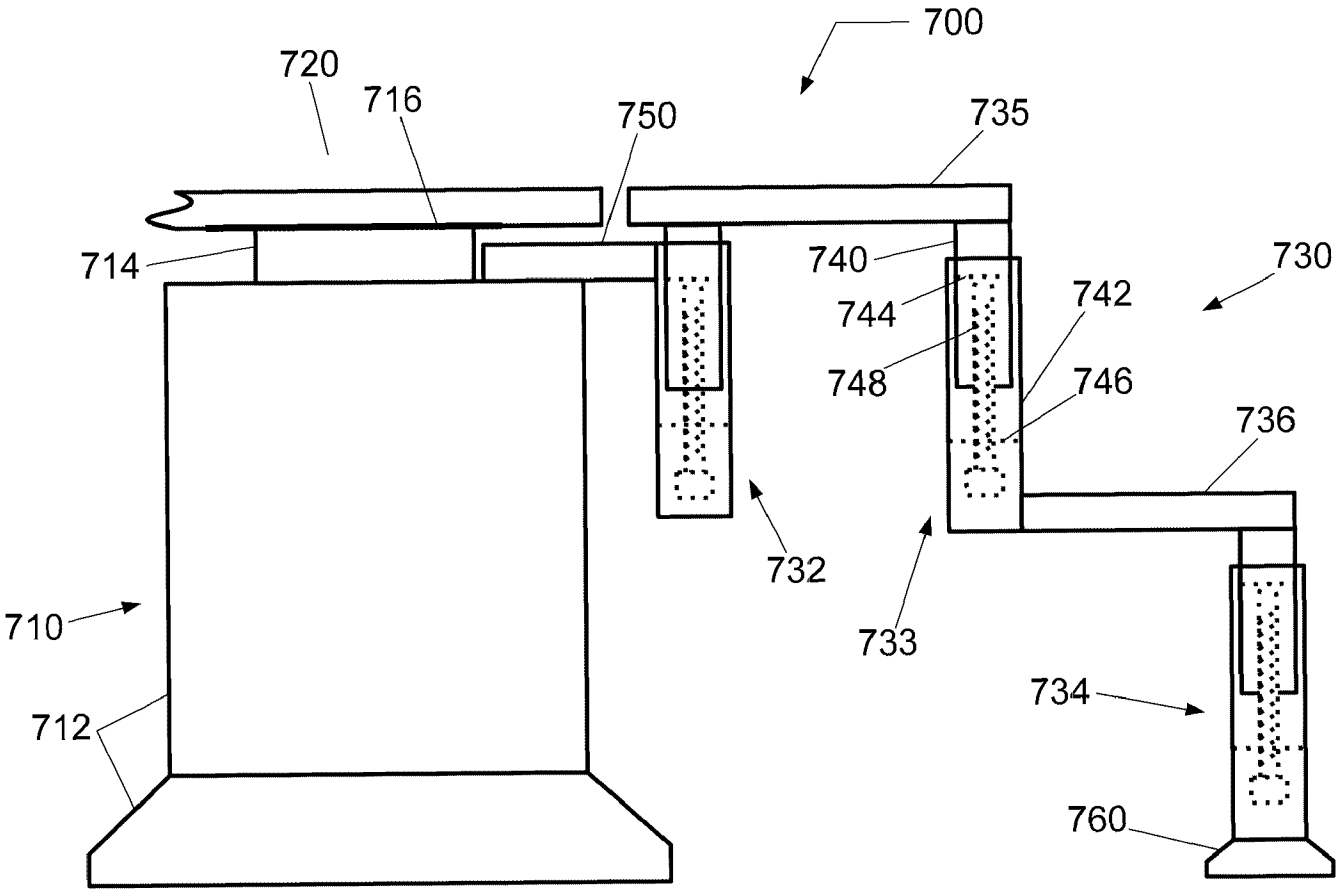
FIG. 5 provides a partial side view of a free standing structure according to another embodiment.

Referring now to FIG. 5, a partial side view of a free standing structure 700 is illustrated according to another embodiment. The free standing structure 700 comprises one or more modular platform structures 720 supported by a plurality of adjustable structural footings 710. Further, the free standing structure 700 comprises a modular stair system having adjustable stairs 730 configured to mate and be supported by the one or more structural footings 710. As described above, the one or more structural footings 710 may comprise a base member 712, a support member 716, and an adjustable leveling device 714 disposed there between.

The adjustable stairs 730 comprise a first end configured to mate with at least one of the one or more structural footings 710 and a second end configured to land on a ground surface as shown in FIG. 5. Alternatively, the adjustable stairs 730 comprise a first end configured to mate with at least one of the one or more modular platform structures 720 and a second end configured to land on a ground surface. Alternatively yet, the adjustable stairs 730 comprise a first end configured to mate with a support member of at least one of the one or more structural footings 710 and a second end configured to land on a ground surface. As shown in FIG. 5, the adjustable stairs 730 comprise one or more adjustable risers 732, 733, and 734 configured to adjustably support one or more treads 735 and 736.

Each adjustable riser 732, 734, and 736 may comprise an upper section 740, a lower section 742, and an height adjustment device disposed there between. The height adjustment device may comprise one or more threaded bolts 748 configured to intimately mate with one or more tapped holes through a first static plate 746 coupled to the lower portion 742 and adjust a height of the upper section 740 relative to the lower section 742 by supporting a second static plate 744 coupled to the upper section 740. As the one or more threaded bolts 748 are rotated through the tapped holes in the first static plate 746, the vertical height of the upper section 740 may be adjusted. As described above, other adjustment devices may be employed including slides and latching mechanisms.

Referring still to FIG. 5, the adjustable stairs 730 may comprise a flared footing 760 coupled to a bottom of adjustable riser 734. Further the adjustable stairs 730 comprise a landing 750 configured to mate with at least one of the one or more structural footings 710.

Figure 6A:
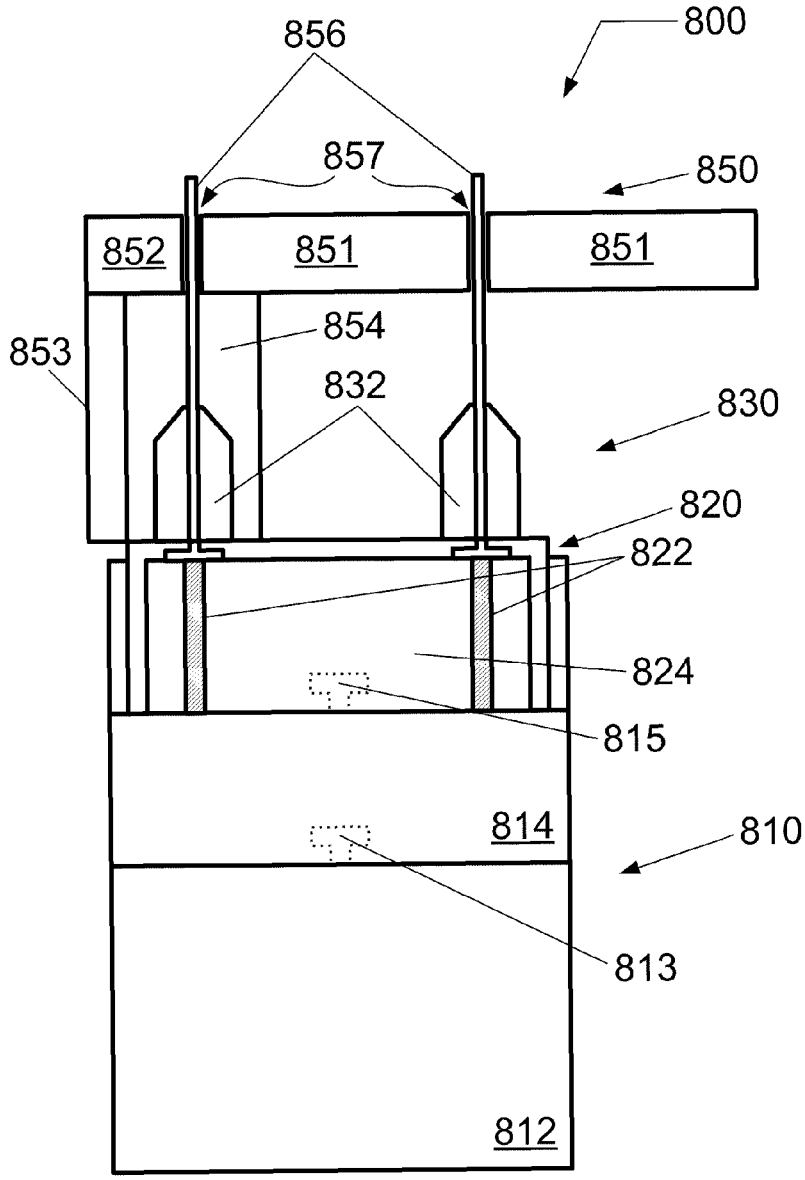
FIGS. 6A and 6B provide a side view of a structural footing according to another embodiment.
Figure 7:
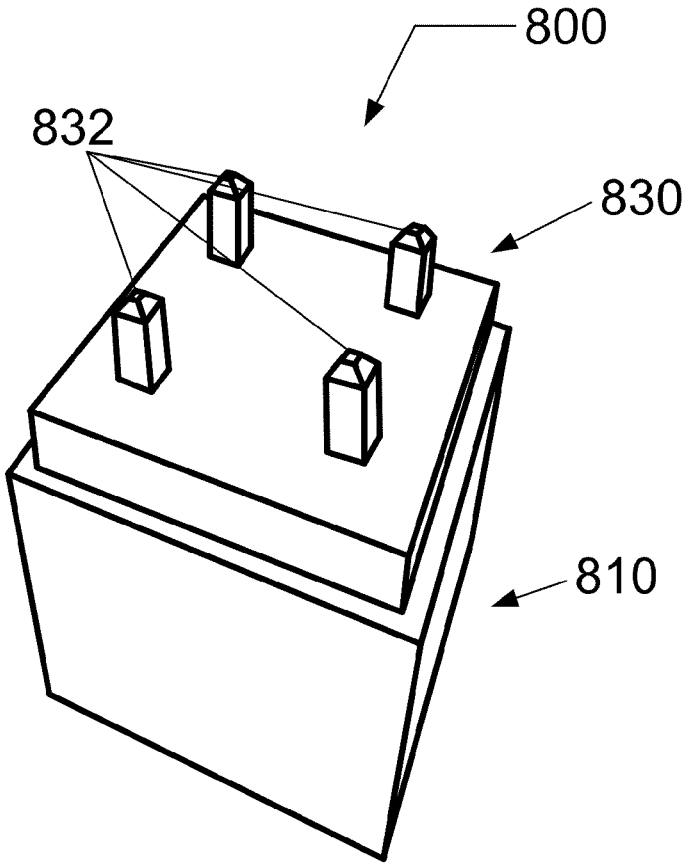
FIG. 7 provides a perspective view of a structural footing according to another embodiment.

Referring now to FIGS. 6A and 7, a side view and a perspective view of a structural footing 800 is provided according to another embodiment. The structural footing 800 comprises a support member 830 configured to provide vertical support to one or more modular platform structures 850, a base member 810, and an adjustable leveling mechanism 820 disposed between the support member 830 and the base member 810, and configured to level adjoining modular platform structures 850 by adjusting a height of the support member 830 relative to the base member 810. As shown in FIG. 6A, the one or more modular platform structures 850 may comprise a deck having a decking platform supported by a joist structure 854. The decking platform may comprise a plurality of platform boards 851 supported by the joist structure 854. Additionally, the decking platform may comprise a trim board 852 and a fascia board 853 to cover an outer edge thereof.

The support member 830 may be configured to provide horizontal interconnectivity for the one or more modular platform structures 850. For example, as shown in FIG. 6A, the support member 830 may comprise one or more interlocking members 832, such as interlocking posts, configured to insert into the joist structure 854 and secure horizontal movement and/or vertical movement of the one or more modular platform structures 850.

Although a deck is illustrated, the structural footing 800 may be configured for other free standing structures, such as patios, gazebos, or sheds that stand off the ground at any supportable height. As an example, the structural footing 800 may be configured for free standing structures that stand up to 30 inches off the ground in order to satisfy national building code which requires footings to extend below the frost level in geographic areas with frost for structures standing above 30 inches off the ground.

The structural footing 800 can provide both vertical support for modular platform structures, while providing adjustable leveling capability and horizontal support and/or connectivity that may have the ability to secure multiple, independent modular platform structures, such as structural decking sections and/or modules, into one combined structural unit or free standing structure. For instance, independent, structural deck modules can be leveled and joined together by a single footing device.

The adjustable leveling capability may have multiple, independent, adjustable vertical supports that may support and connect multiple, independent structural deck modules in one common footing. For example, a platform deck can have one inside corner adjustable footing that may be able to support and connect four independent structural deck modules. This footing provides an easy-to-use, easy-to-level deck footing for the do-it-yourself consumer or for a professional installer to save time and money.

Additionally, the structural footing 800 may have the ability to support and secure multi-level deck platforms in one common footing device. There may be different lengths of footings available to support a deck up to 30 inches off the ground. The different footing lengths may be necessary to keep a deck level in areas with sloping terrain or uneven terrain. Since each structural footing may have a maximum ability to adjust the platform, then the different lengths of footings may provide for a improved application for terrains with more than several inches of change from the deck leveling between footings.

Further, each structural footing 800 may be able to accommodate multiple configurations for the support member 830 in one common base. This ability may allow for a structural footing that may be used for an inside corner, an outside corner, an interior vertex, or an outer edge (or run) for multiple modular structural platforms. These multiple securing plate configurations may be for inside corners, outside corners, interior vertices, outside edges, or even a change in height between modules for a multi-level free standing structure. Additionally, if the free standing structure is to be expanded in size, the same footings may be used and the support members may be changed to accommodate the new layout. Each structural footing allows for ease-of-use in assembling, and in disassembling in the case of re-leveling, moving to a new location or changing the layout.

As shown in FIG. 6A, the structural footing 800 comprises base member 810 having one or more footing sections. For example, as illustrated in FIG. 6A, the base member 810 may comprise an upper footing section 814 and a lower footing section 812 coupled to the upper footing section 814. The upper footing section 814 and the lower footing section 812 are fixed height footing sections that may be stacked upon one another and interlocked to achieve a desired height for the free standing structure. For example, these fixed height footing sections may be available in different sizes, i.e., 3 inch sections, 6 inch sections, 12 inch sections, etc.; however, other sizes may be available As a result, the height of a free standing structure may be coarsely adjusted for a variety of terrains, including level terrain, sloped terrain, and mixtures thereof, using the fixed height footing sections when assembling the base member 810, and then finely adjusted using the adjustable leveling mechanism 820.

As indicated above, the upper footing section 814 and the lower footing section 812 may have an interlocking mechanism 813 and 815, respectively. The interlocking mechanism (813 and 815) may include an interlocking "T" that connects adjacent fixed height footing sections by sliding into a top surface of each footing section and twisting 90 degrees to lock. The interlocking "T" may be located in the center of the top surface of each footing section. As shown in FIG. 6A, the adjustable leveling mechanism 820 may be coupled to and interlocked with the base member 810.

Referring still to FIG. 6A, the adjustable leveling mechanism 820 comprises one or more support bolts 822 having an end in contact with a bottom of the support member 830. The one or more support bolts 822 are configured to support and adjust the height of the support member 830 relative to the base member 810. As shown in FIG. 6A, the one or more support bolts 822 comprise threaded sections which intimately mate with tapped holes supported within static member 824. As the one or more support bolts 822 are rotated through the tapped holes in the static member 824, the vertical height of the support member 830 may be adjusted.

Although the adjustable leveling mechanism 820 is shown to comprise one or more support bolts 822, other devices may be employed to adjust the support member 830 relative to the base member 810. The adjustable leveling mechanism 820 may comprise one or more slides with one or more latching devices. For example, the adjustable leveling mechanism 820 may comprise one or more first cylinders coupled to the support member 830 and one or more second cylinders, concentric with the one or more first cylinders, coupled to the base member 810. One or more spring-loaded devices coupled to an interior cylinder may insert a bolt or plug through holes that align between the interior cylinder and an exterior cylinder. The one or more spring-loaded devices may include a helical spring or loaded lever, for instance. Although in this example, cylinders are suggested other cross-sectional shapes may be used, including square cross-sections, rectangular cross-sections, or angle iron.

Figure 6B:
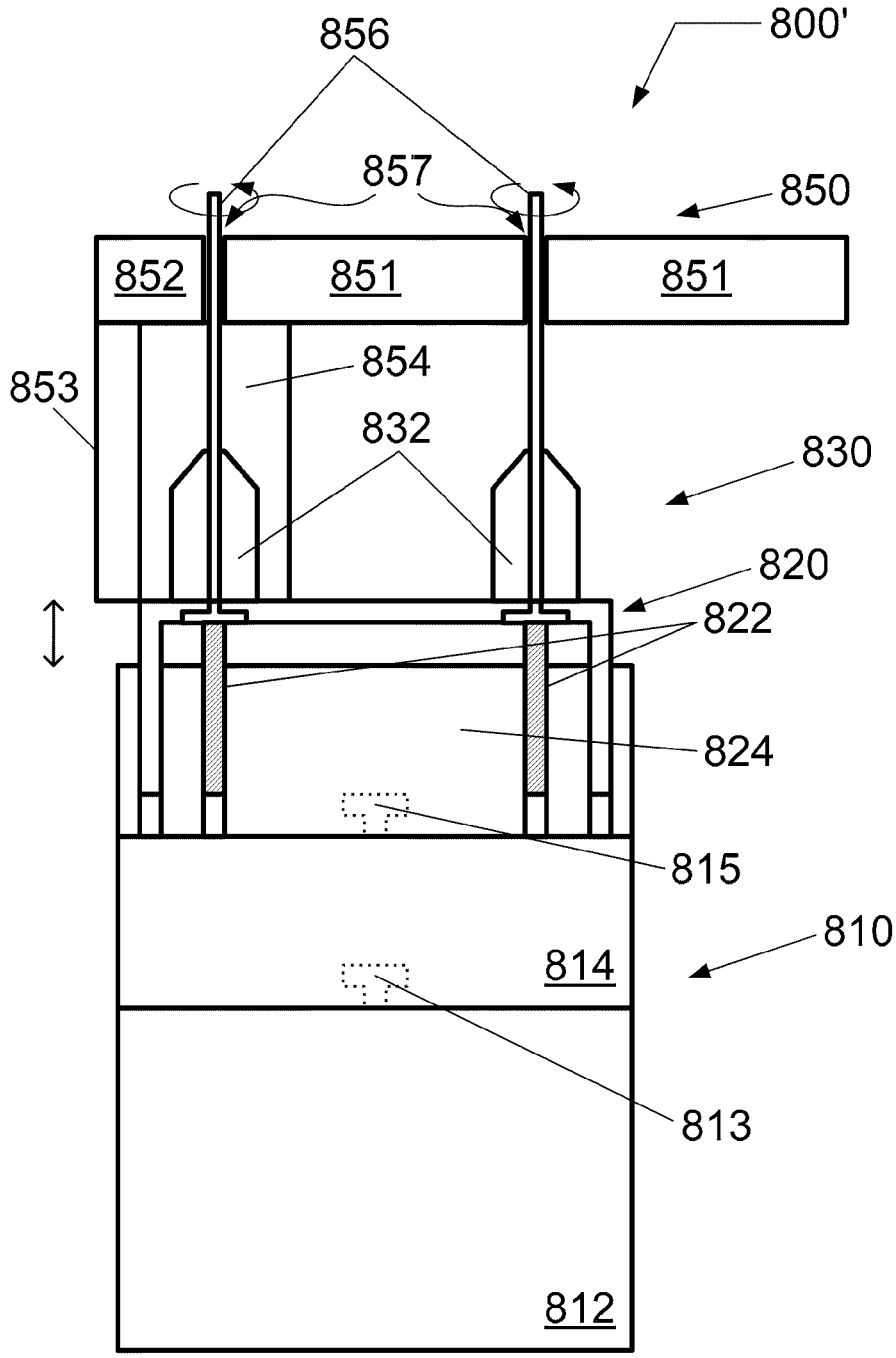

Referring now to FIG. 6B, a structural footing 800' is illustrated when the adjustable leveling mechanism 820 is utilized to adjust the height of the structural footing 800' by vertically elevating the support member 830 relative to the base member 810. One or more adjustment tools 856 are configured to extend through openings 857 in the decking platform, through the joist structure 854, and through the one or more interlocking members 832 to engage the one or more support bolts 822. For example, the openings 857 in the decking platform may include a quarter inch spacing set between adjacent platform boards 851 and trim boards 852 of the decking platform. Rotation of the one or more adjustment tools 856 (as illustrated in FIG. 6B) and the corresponding rotation of the one or more support bolts 822 causes vertical translation of the support member 830 relative to the base member 810.

A range for adjusting the support member 830 relative to the base member 810 using the one or more support bolts 822 may range from about 1 inch to about 12 inches. Alternatively, a range for adjusting the support member 830 relative to the base member 810 using the one or more support bolts 822 may range from about 1 inch to about 10 inches. Alternatively yet, a range for adjusting the support member 830 relative to the base member 810 using the one or more support bolts 822 may range from about 4 inches to about 7 inches. This range may vary depending on the size and structural support strength of each support mechanism, for instance.

Figure 8:
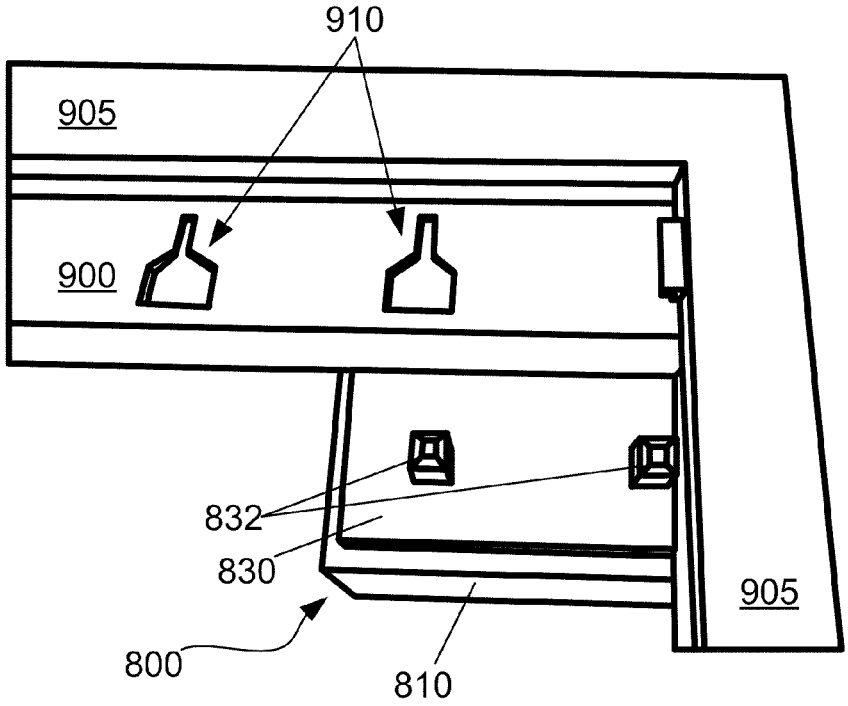
FIG. 8 provides a partial top view of a modular free standing structure according to another embodiment.

As an example, referring to FIG. 8, a partial top view of footing structure 800 is illustrated in support of a modular platform structure at a corner thereof. The modular platform structure may include a decking platform having a plurality of platform boards and trim boards 905 supported in part by an interlocking joist 900, wherein the plurality of platform boards are not illustrated in order to reveal the underlying joist 900 and footing structure 800.

Figure 9A:
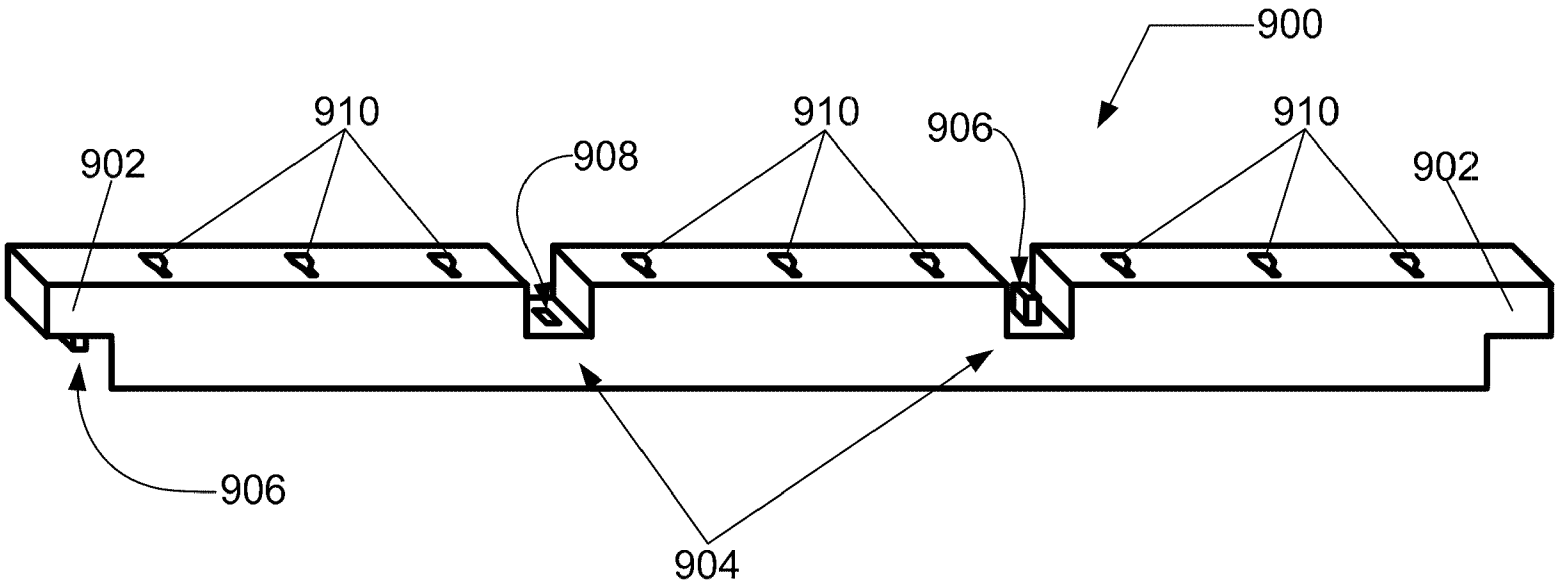
FIGS. 9A and 9B provide perspective views of an interlocking joist and a joist structure according to another embodiment.
Figure 9B:
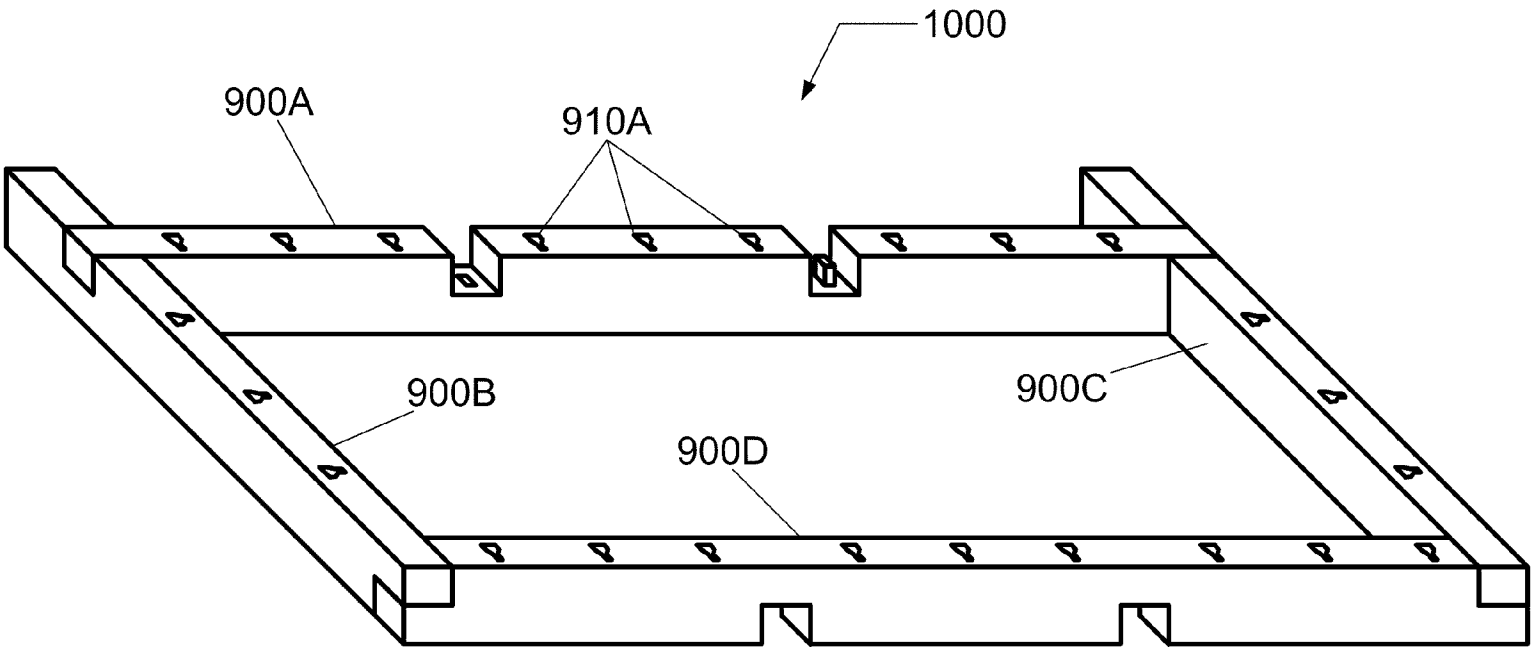

Referring now to FIGS. 9A and 9B, interlocking joist 900 and a modular joist structure 1000 within which the interlocking joist 900 may be assembled are illustrated, respectively, according to embodiments of the invention. As shown in FIG. 9A, the interlocking joist 900 may comprise one or more interlocking ledges 902, such as at either end of the interlocking joist 900, and one or more interlocking troughs 904, such as within the interior of the interlocking joist 900. Each interlocking ledge 902 and interlocking trough 904 may include either a mating post 906 or a mating receptacle 908. The mating receptacle 908 is configured to receive the mating post 906 in order to align and secure interlocking joist 900 with another interlocking joist. Further, the mating post 906 may be designed to be rotatable such that once the mating post 906 of interlocking joist 900 is aligned with and inserted into a mating receptacle of another interlocking joist, it may be rotated to lock the interlocking joists to one another.

As illustrated in FIGS. 9A and 9B, the interlocking joist 900 may be designed to be universal, i.e., reversible and interchangeable. As shown in FIG. 9B, interlocking joists 900A, 900B, 900C, and 900D are structurally the same, yet oriented differently within the modular joist structure 1000. For instance, interlocking joist 900A is flipped upside down relative to interlocking joist 900D. Therefore, any interlocking joist 900A, 900B, 900C, and 900D may be utilized in any position of the modular joist structure 1000. The universality of the interlocking joist 900 provides ease of packaging, ease of shipping, ease of storage, ease of retail display, and ease of use, among other things.

As shown in FIG. 9B, an interlocking ledge of an interlocking joist may mate with an interlocking trough of another interlocking joist, e.g., see the joinder of interlocking joist 900A with interlocking joists 900B and 900C in FIG. 9B. Additionally, an interlocking ledge of an interlocking joist may mate with an interlocking ledge of another interlocking joist, e.g., see the joinder of interlocking joist 900D with interlocking joists 900B and 900C in FIG. 9B. Furthermore, although not shown, an interlocking trough of an interlocking joist may mate with the interlocking trough of another interlocking joist.

The interlocking joist 900 may, for example, be manufactured using an injection molding process with a structural plastic or cast aluminum material.

Referring now to FIGS. 9A, 9B, 10A, 10B, and 10C, the interlocking joist 900 (or 900A) further comprises one or more receiving openings 910 (or 910A) configured to receive one or more fastening devices 950 configured to secure one or more of a plurality of platform boards 1050 to a module frame that may include the modular joist structure 1000 of FIG. 9B. For example, the one or more fastening devices 950 may be configured to mate with at least one of the plurality of platform boards 1050 and are configured to interlock with at least one of the one or more receiving openings 910 in the module frame.

The module frame, including any one of the decking platform, the platform board(s), the trim board(s), the fascia board(s), or the joist structure, may be fabricated from a single piece, such as molded from a structural plastic. This single piece module frame may be readily connected to and/or disconnected from structural footings.

Figure 10A:
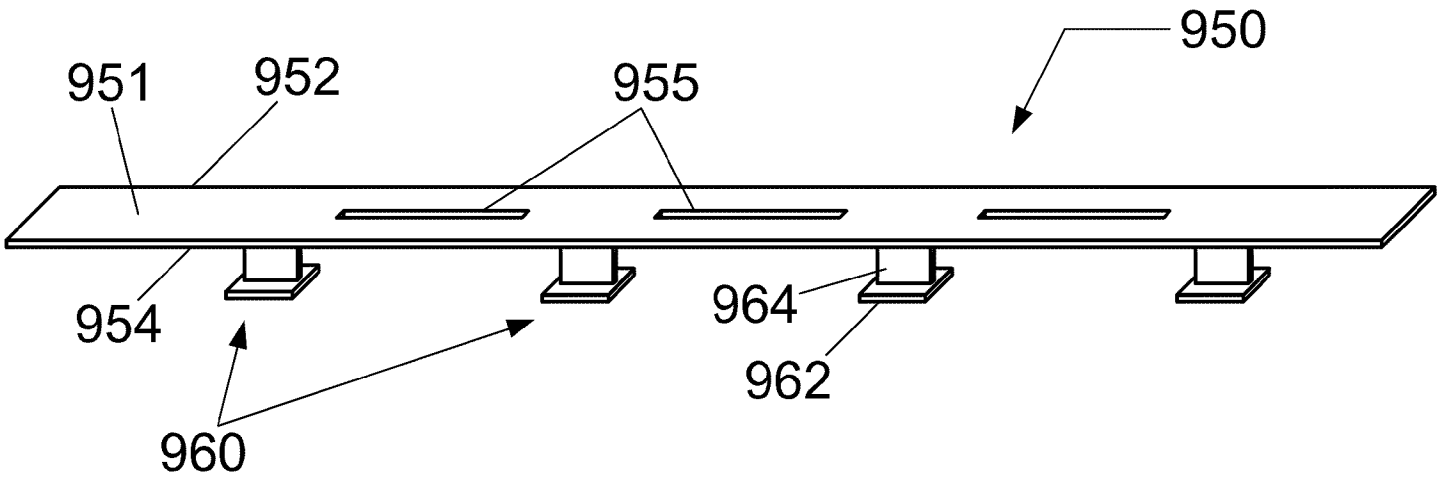
FIGS. 10A through 10C provide a series of illustrations of a fastening device according to another embodiment.
Figure 10B:
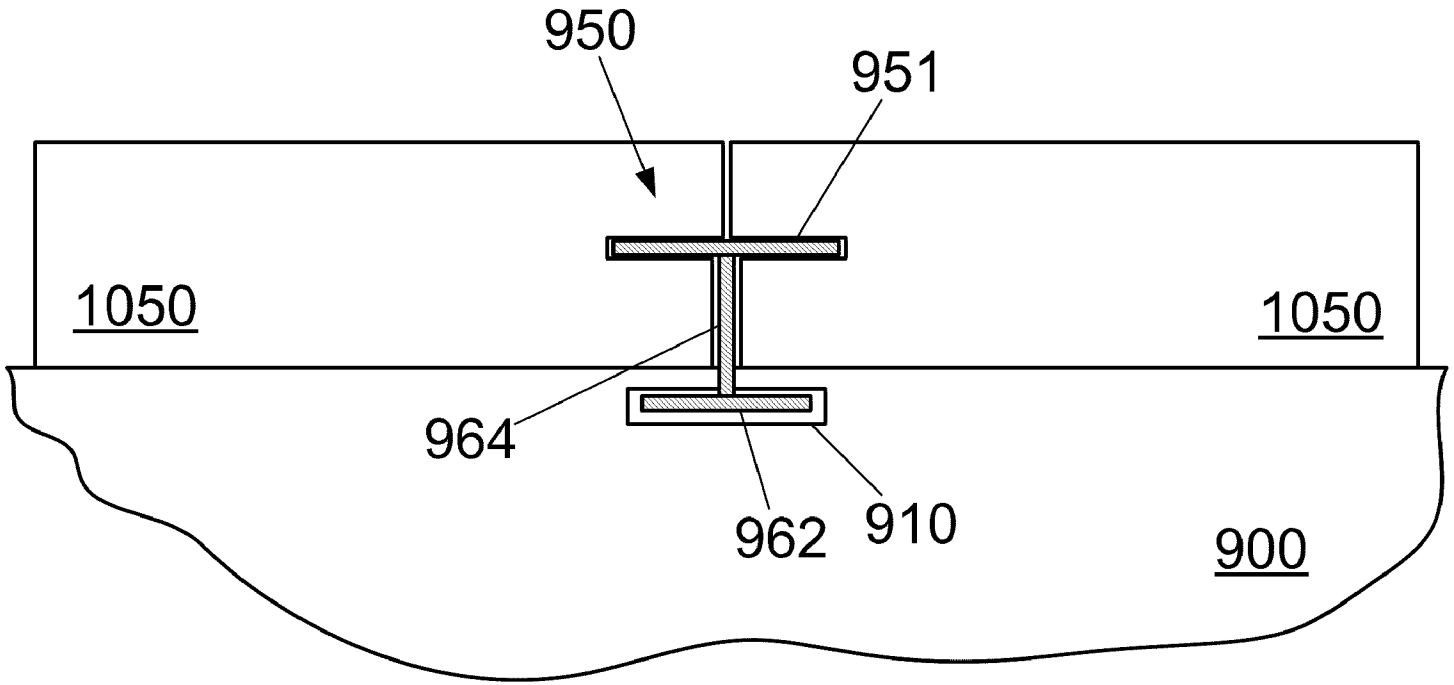

As shown in FIGS. 10A and 10B, each of the one or more fastening devices 950 comprises a fastening strip 951 having fastening edges 952 and 954 configured to mate with a groove formed in the edge of at least one of the one or more platform boards 1050. Additionally, each of the one or more fastening devices 950 comprises one or more fastening members 960 configured to insert into the one or more receiving openings 910 in the module frame and slide in the one or more receiving openings 910 to lock each of the one or more fastening devices 950 to the module frame. Each fastening member 960 comprises a latching member 962 and a wall member 964 extending between the fastening strip 951 and the latching member 962.

Figure 10C:
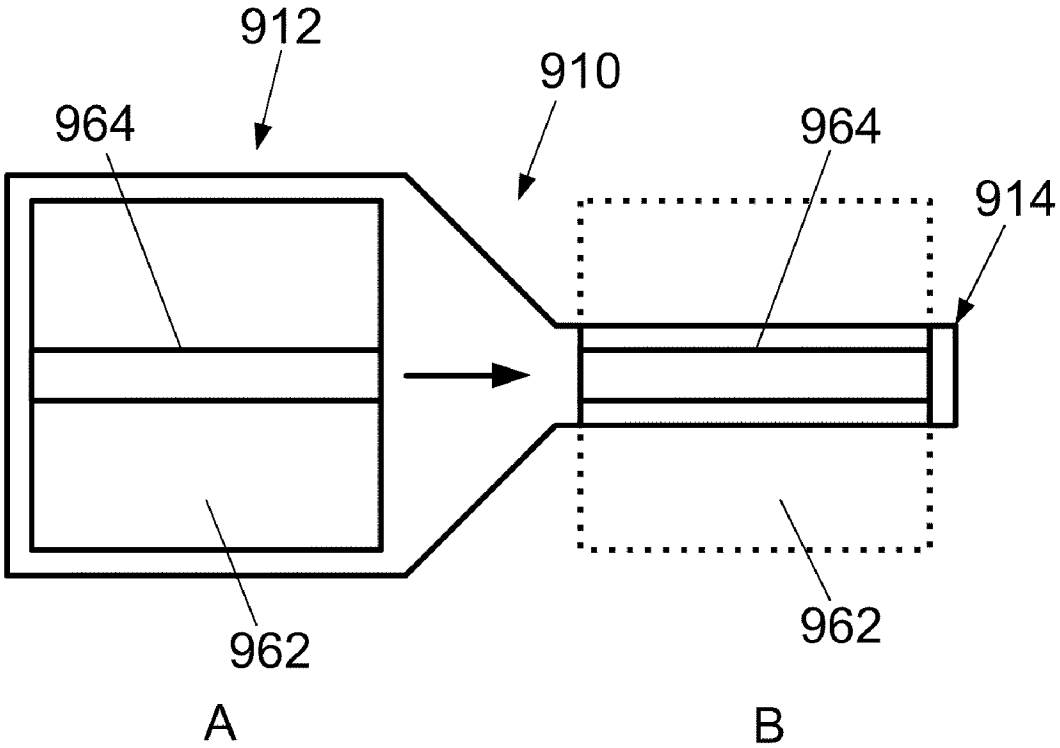

As shown in FIGS. 10A, 10B, and 10C, the fastening strip 951 initially engages the one or more platform boards 1050 such that the wall member 964 extends from the fastening strip 951 between the one or more platform boards 1050 while the latching member 962 extends into a first opening 912 of at least one of the one or more receiving openings 910 (position "A"). As illustrated in FIG. 10C, the first opening 912 has an area sufficiently large to receive the latching member 962 of the fastening member 960. Thereafter, the fastening strip 951 secures the one or more platform boards 1050 when the fastening strip 951 slides from the first opening (position "A") to a second opening 914 (position "B"), wherein the second opening 914 is smaller than the first opening 912 yet sufficiently large to allow the wall member 964 to extend there through. In position "B", the latching member 962 is captured by the receiving opening 910 in interlocking joist 900.

Figure 11:
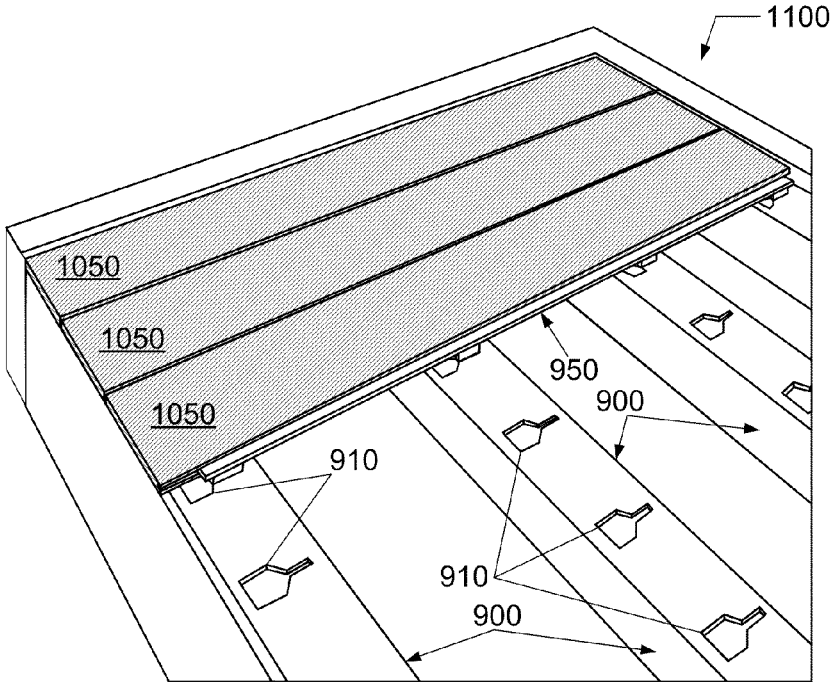
FIG. 11 provides a perspective view of a modular free standing structure according to yet another embodiment.

Referring now to FIG. 11, a partial perspective view of a free standing structure 1100 is provided according to yet another embodiment. The free standing structure 1100 comprises the plurality of platform boards 1050, and the modular joist structure having one or more interlocking joists 900, wherein the modular joist structure is configured to support the plurality of platform boards 1050. Additionally, the free standing structure comprises one or more fastening devices 950 configured to secure the plurality of platform boards 1050 to the modular joist structure via receiving openings 910 in the interlocking joists 900. Furthermore, the free standing structure 1100 may comprise a plurality of structural footings (not shown) configured to adjustably support the modular joist structure.

Although only certain embodiments of this invention have been described in detail above, those skilled in the art will readily appreciate that many modifications are possible in the embodiments without materially departing from the novel teachings and advantages of this invention. Accordingly, all such modifications are intended to be included within the scope of this invention.

What is claimed is:

1. A structural footing configured to support a free standing structure, comprising:

a support member having a support surface configured to provide vertical support to one or more modular platform structures, said support member comprising one or more interlocking members extending vertically upward from said support surface to secure horizontal movement of said one or more modular platform structures;

a base member; and an adjustable leveling mechanism disposed between said support member and said base member, and configured to level said one or more modular platform structures by adjusting a height of said support member relative to said base member along a vertical axis of said structural footing, said adjustable leveling mechanism comprising:

a static member supported by said base member, and a plurality of support bolts, each of which includes a first end supporting said support member and a second end having a threaded section mating with a corresponding one of a plurality of tapped holes formed within said static member, wherein rotation of said plurality of support bolts within said plurality of tapped holes allows for adjusting said height of said support member relative to said base member and altering a tilt angle of said support surface.

2. The structural footing of claim 1, wherein said one or more interlocking members comprises one or more interlocking posts, each of which is configured to insert into an opening formed within a joist structure of said one or more modular platform structures.

3. The structural footing of claim 2, wherein at least one of said one or more interlocking posts includes an opening extending there through along a longitudinal axis thereof, said opening allowing access of an adjustment tool from above said one or more modular platforms to at least one of said plurality of support bolts for adjusting said height of said support member relative to said base member.

4. The structural footing of claim 1, wherein said base member comprises an adjustable base member configured to adjust a vertical height of said base member.

5. The structural footing of claim 1, wherein said base member comprises a main footing, and an expanded base coupled to said main footing to provide stability to said structural footing, and wherein said main footing comprises:

an upper footing section; and a lower footing section coupled to said upper footing section and said expanded base.

6. The structural footing of claim 5, wherein said upper footing section is adjustable relative to said lower footing section.

7. The structural footing of claim 5, wherein said upper footing section has a different vertical size than said lower footing section.

8. The structural footing of claim 1, further comprising:

adjustable stairs having a first end configured to mate with said base member and a second end configured to land on a ground surface.

9. The structural footing of claim 1, wherein said base member comprises:

a lower footing section;

an upper footing section stackable on top of said lower footing section; and an interlocking mechanism disposed between mating surfaces of said lower footing section and said upper footing section that connects said upper footing section to said lower footing section when said upper footing section is engaged with said lower footing section and rotated relative to said lower footing section.

10. The structural footing of claim 9, wherein said interlocking mechanism comprises an interlocking T-shaped member extending from a first mating surface located on said lower footing section, and a T-shaped cavity located within a second mating surface of said upper footing section that is configured to receive said T-shaped member when said upper footing section is engaged with said lower footing section and interlock with said T-shaped member with said upper footing section is rotated relative to said lower footing section.

11. A modular platform structure, comprising:

a plurality of platform boards;

a module frame having an upper surface configured to support said plurality of platform boards, wherein said module frame comprises one or more receiving openings formed into said upper surface;

one or more fastening devices securing said plurality of platform boards to said module frame, wherein each of said one or more fastening devices includes a fastening strip having one or more fastening members extending therefrom and wherein said fastening strip is mated with at least one of said plurality of platform boards and fastens said at least one of said plurality of platform boards to said module frame by inserting at least one of said one or more fastening members into at least one of said one or more receiving openings and sliding said fastening strip in a direction relative to and parallel with said upper surface of said module frame;

wherein said fastening strip comprises a fastening edge with mates with a groove formed within an edge of at least one of said one or more platform boards; and wherein each of said one or more fastening members extending from said fastening strip includes a latching member and a wall member extending there between, and wherein each of said one or more receiving openings in said module frame has a first opening with an area larger than said latching member to allow insertion of said latching member into said first opening, and a second opening, contiguous with said first opening, with an area smaller than said latching member to allow capturing of said latching member when said fastening strip is slid in a direction relative to and parallel with said upper surface of said module frame.

12. The modular platform structure of claim 11, wherein said module frame comprises a modular joist structure having one or more interlocking joists, and wherein each of said one or more interlocking joists comprises one or more of said one or more receiving openings.

13. The modular platform structure of claim 11, further comprising:

adjustable stairs having a first end configured to mate with said module frame and a second end configured to land on a ground surface.

14. The modular platform structure of claim 11, further comprising:

a plurality of adjustable structural footings configured to support said module frame, each adjustable structural footing comprises:

a support member having a support surface configured to provide vertical support to said module frame, said support member comprising one or more interlocking members extending vertically upward from said support surface to secure horizontal movement of said module frame;

a base member; and an adjustable leveling mechanism disposed between said support member and said base member, and configured to level said module frame by adjusting a height of said support member relative to said base member along a vertical axis of said adjustable structural footing.

15. The modular platform structure of claim 14, wherein said adjustable leveling mechanism comprises;

a static member supported by said base member, and a plurality of support bolts, each of which includes a first end configured to support said support member and a second end having a threaded section configured to mate with a corresponding one of a plurality of tapped holes formed within said static member, wherein rotation of said plurality of support bolts within said plurality of tapped holes allows for adjusting said height of said support member relative to said base member and altering a tilt angle of said support surface.

16. A free standing structure, comprising:

a plurality of platform boards;

a modular joist structure having one or more interlocking joists, said modular joist structure having an upper surface supporting said plurality of platform boards;

one or more fastening devices securing said plurality of platform boards to said modular joist structure; and a plurality of structural footings adjustably supporting said modular joist structure, wherein at least one of said plurality of structural footings comprises:

a support member having a support surface providing vertical support to said modular joist structure, said support member comprising one or more interlocking members extending vertically upward from said support surface to secure horizontal movement of said modular joist structure;

a base member; and an adjustable leveling mechanism disposed between said support member and said base member, and leveling said modular joist structure by adjusting a height of said support member relative to said base member along a vertical axis of said structural footing, said adjustable leveling mechanism comprising:

a static member supported by said base member, and a plurality of support bolts, each of which includes a first end supporting said support member and a second end having a threaded section mating with a corresponding one of a plurality of tapped holes formed within said static member, wherein rotation of said plurality of support bolts within said plurality of tapped holes allows for adjusting said height of said support member relative to said base member and altering a tilt angle of said support surface.

17. The free standing structures of claim 16, further comprising:

adjustable stairs having a first end configured to mate with said modular joist structure or at least one of said plurality of structural footings, and a second end configured to land on a ground surface.

18. The free standing structure of claim 16, wherein each of said one or more fastening devices includes a fastening strip having one or more fastening members extending therefrom, and wherein said fastening strip is configured to mate with at least one of said plurality of platform boards and is configured to fasten said at least one of said plurality of platform boards to said modular joist structure by inserting at least one of said one or more fastening members into at least one of said one or more receiving openings and sliding said fastening strip in a direction relative to and parallel with said upper surface of said modular joist structure.

* * * * *